US005097813A

United States Patent [19]

Reiser et al.

[11] Patent Number: 5,097,813

[45] Date of Patent: Mar. 24, 1992

[54] FUEL PRE-HEATER FOR LIQUID FUELED ENGINE

[75] Inventors: Peter Reiser, Esslingen/Neckar; Fritz Mohring, Ostfildern; Adolf Schodt, Esslingen/Neckar, all of Fed. Rep. of Germany

[73] Assignee: J. Eberspächer, Esslingen, Fed. Rep. of Germany

[21] Appl. No.: 616,888

[22] Filed: Nov. 21, 1990

Related U.S. Application Data

[62] Division of Ser. No. 210,630, Jun. 23, 1988, Pat. No. 5,022,851.

[30] Foreign Application Priority Data

Feb. 7, 1987 [DE] Fed. Rep. of Germany ..... 3721834

[51] Int. Cl.[5] ..... F02M 31/00

[52] U.S. Cl. ..... 123/557; 123/546; 123/514; 165/169

[58] Field of Search ..... 123/557, 546, 514; 165/169, 51, 52; 122/14

[56] References Cited

U.S. PATENT DOCUMENTS

| | | | |
|---|---|---|---|
| 1,384,512 | 7/1921 | Buchi | 123/557 |
| 1,442,258 | 1/1923 | Dorris | 123/557 |
| 1,937,013 | 11/1933 | Engelmann | 123/557 |
| 4,343,283 | 8/1982 | Shepherd | 123/557 |
| 4,411,239 | 10/1983 | Kelch | 123/557 |
| 4,432,329 | 2/1984 | Redele | 123/557 |
| 4,436,075 | 3/1984 | Campbell et al. | 123/557 |
| 4,562,820 | 1/1986 | Jiminez | 123/557 |
| 4,719,877 | 1/1988 | Delage | 122/14 |

*Primary Examiner*—E. Rollins Cross
*Assistant Examiner*—M. Macy
*Attorney, Agent, or Firm*—McGlew and Tuttle

[57] ABSTRACT

A heating device for pre-heating liquid fuel, especially diesel fuel and for heating devices of a low heating performance which are independent from a motor have a heating performance which is suitable for mounting into vehicles, which are driven by the liquid fuel. The pre-heating is effected by a transmission of heat of the exhaust gas to the fuel of the heating device, the fuel being lead through a continuous tubular wrapping in one layer or through a hollow cylinder formed or positioned around the exhaust pipe. This wrapping or hollow cylinder is part of the fuel main from the fuel tank to the fuel supply pump of the heating device. A pre-heating of the content of the tank is effected by the return of the pre-heated, but not burnt fuel through a fuel return main back into the tank. A heat transmitting jacket is advantageously disposed between the wrapping, or a hollow cylinder and the exhaust gas pipe.

11 Claims, 4 Drawing Sheets

FIG. 4
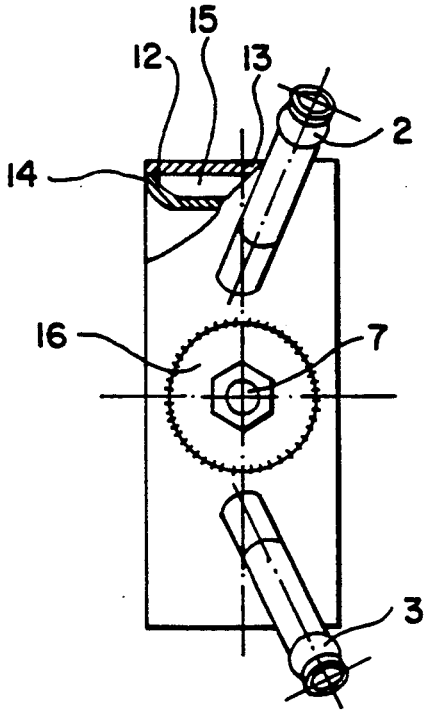
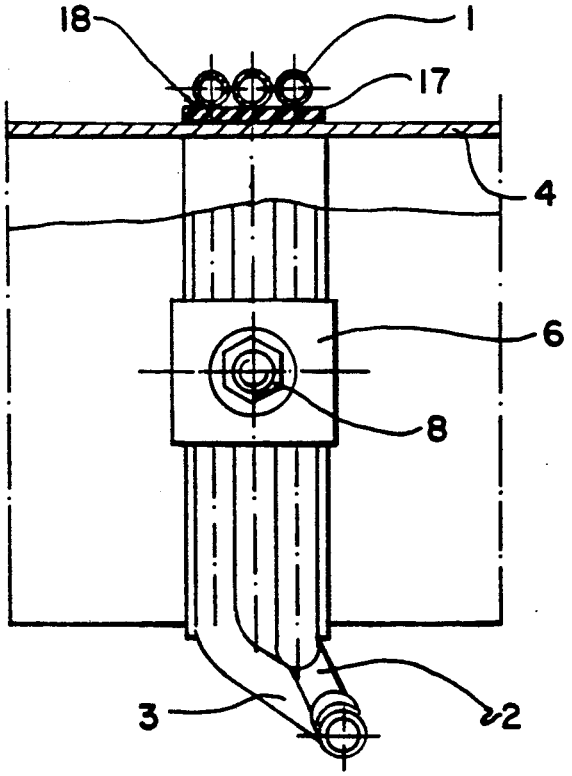
FIG. 5

FUEL PRE-HEATER FOR LIQUID FUELED ENGINE

This is a divisional application of application Ser. No. 210,630 filed June 23, 1988, now U.S. Pat. No. 5,022,851.

BACKGROUND OF THE INVENTION

1. Field of the Invention

This invention relates in general to liquid fuel heaters and in particular to a new and useful device for the pre-heating of liquid fuel for heating installations in mobile units.

The present invention comprises a fuel tank and a fuel line or main between the tank and the fuel pump, which is part of the heating installation as well as comprising a fuel return pipe and an exhaust main, which leads the exhaust gases out of the combustion chamber of the heating installation.

Such heat installations are used, for example, for automobiles, in order to heat the inside space independently from the motor and for water cooled motors for pre-warming the motor. Other fields of use are boats and construction machines. Corresponding to the conditions for mounting, and to the volume to be heated, these heating devices are relatively small and have only a small consumption of fuel.

For this reason the fuel lines or mains have a small diameter. Naturally these heating devices have to work reliably, especially when there is a very low outside temperature. Especially for heating devices working with diesel fuel, it is known that there is a risk at low temperatures that the fuel becomes like a jelly, and this causes inevitably the heating installation to get out of commission. For this reason improvers of fluidity are added to the fuel, in order to keep it from becoming like a jelly.

For the operation of a mechanical atomizer (burner) heating or pre-heating of the nozzles is sufficient even when the outside temperatures are low. However, this pre-heating of the nozzles is effective only if the fuel is supplied in a sufficient quantity and consistency. This pre-heating of the nozzles requires additional electric energy out of the power supply for plane communication apparatus, and therefore should be driven only during the starting operation. In general, when the device is started, the heat, which is in the heating device is sufficient for the further operation.

The disadvantages of the known installations relate especially to the fact that not only during the starting process, but also during the whole operating period electric energy is necessary from the supply on board, which, in the cold period of the year, is already highly strained with the connection of additional, energy consuming devices such as a heater of the vehicle and of the panes as well as the lighting system.

SUMMARY OF THE INVENTION

The invention provides a pre-heating installation for liquid fuel for heating devices in mobile units, and, to guarantee an operation without disturbances at low temperatures and without use of electric energy, the installation is suitable for a subsequent mounting and is especially simple and safe in its construction and operation.

It has been found that the task can be resolved in a surprisingly simple way, without leading to a cracking of the fuel, as it has been presumed so far.

According to the invention, at least a part of the main, extending between the fuel tank and the fuel pump is in a heat transmitting contact with the main, which carries the exhaust pipe. It appeared that, contrary to what has been presumed until today, a sufficient heating up of the fuel is possible without incurring cracking in the fuel, which can disturb the operation of the device. Besides, this pre-heating of the entire quantity of fuel before the heating installation provides the advantage, that by means of the portion of fuel, which is returned to the tank through the return flow main, the temperature of the fuel supply is increased and thus its liquidity is improved, even at extremely low temperatures.

A very advantageous development of the invention is characterized in that the fuel main provides a section which wraps the exhaust gas main of the heating installation, the section being made up of a wrapping in one layer of the fuel main and being disposed on a jacket, through which the heat transmitting contact with the exhaust gas main is carried out. For this development the fuel main is wrapped in about 3–4 windings between the fuel tank and the fuel pump of the heating device and this wrapping is pushed into a jacket, the diameter of which fits precisely to the outer diameter of the exhaust gas pipe of the heating device, the jacket and the wrapping being connected to each other firmly by a hard soldering. The thickness of the walls of the jacket is about the same as the inner radius of the fuel main, the length of the jacket being approximately the same as the length of the wrapped section of the fuel main. This arrangement allows the heating of the fuel without a coking.

Pursuant to a further development of the invention, the jacket, bearing the wrapping of the fuel main in one layer can be fashioned out of a heat transmitting round stock, the round stock forming the jacket providing a smaller diameter than the wrapping carrying the fuel. This arrangement differs from the arrangement with a smooth jacket by the heat transmission. The wrapping, which is made up of the heat transmitting stock round, advantageously provides one more winding than the wrapping of the fuel main which sits on the exhaust pipe. The wrapping of the fuel main lies imbedded between two adjacent stock round wrappings, which are disposed at a distance from each other and do not touch the exhaust pipe. The distance of the wrappings of the heat transmitting stock round is selected in such a way, that below the contact line of two fuel mains of the wrapping a stock round section is disposed. Pursuant to the invention the attachment of the wrapping to the exhaust pipe is carried out by at least one wrapping and a clamp embracing the jacket.

Pursuant to an especially suitable embodiment of the invention this clamp is made up of an inner U-shaped part, which is firmly connected to the wrapping and another U-shaped part, which embraces this part. The embracing part is slidable by means of a screw, and thus by tightening the screw, a clamping connection between the installation and the exhaust gas pipe of the heating device is obtained.

Another suitable embodiment for resolving the inventive task is characterized in that the fuel main provides a section, wrapping the exhaust main of the heating device, which is fashioned as a hollow cylinder with a fuel inlet and an outlet main.

In the case of this embodiment, an annular space is formed for the fuel to be pre-heated, the annular space being very easy to manufacture and connecting the fuel inlet with the fuel outlet main.

Pursuant to another further development of this embodiment this hollow cylinder is advantageously disposed on a jacket, and can be attached to it for example, so that, by a certain choice of the materials, an optimal transmission of the heat is obtained. Thus, in this embodiment, as well as with pre-heating of the fuel, it is without a risk of coking. In this embodiment the heat transmitting surface is bigger than in the case of the one which has been described first.

In a further development of the invention, the inner wall of the hollow cylinder is prolonged at one side and a baffle plate is disposed at its end, which is connected by cross pieces, and formed by a flat disk, curved towards the inside. This embodiment is conceived for mounting the installation at the end of the exhaust gas main of the heating device. Therefore the device is slid over the end section of the exhaust gas pipe, and the cross pieces. The cross pieces are attached inside to the inner wall of the hollow cylinder, which is prolonged at one side and have the function of a stop for the exhaust gas pipe. The baffle plate prevents, for example, the exhaust gas from being blown directly onto the roadway and reorients it. The installation can be attached to the exhaust gas pipe by means of screws at the prolonged part of the inner wall of the installation.

Pursuant to a further development of the invention, however, it can be attached through a flange which is formed to the hollow cylinder, for example at a part of the carriage of the vehicle, pursuant to the mounting position of the heating device.

Accordingly, it is an object of the invention to provide a pre-heater for fuel which is directed to an internal combustion device which has an exhaust pipe and which includes a conduit from a fuel supply tank to the internal combustion engine which includes a portion thereof which is wrapped around the exhaust pipe so as to be in heat exchange relationship therewith.

A further object of the invention is to provide a device for pre-heating liquid fuel which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the Drawings:

FIG. 4 is a partial sectional view with a hollow cylinder as the section wrapping the exhaust gas pipe of another embodiment;

FIG. 5 is a sectional view of another embodiment of the invention according to FIG. 1.

DESCRIPTION OF THE PREFERRED EMBODIMENTS

Figure 1:
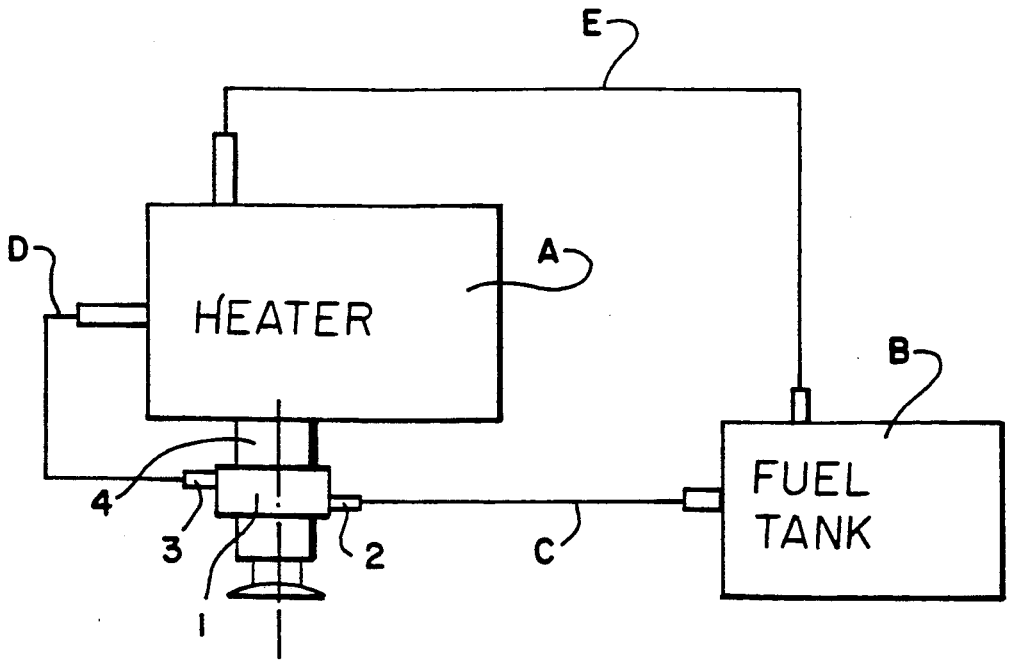
FIG. 1 is a schematic representation of the installation comprising heating device and fuel tank constructed in accordance with the invention.

Referring to the drawings, in particular, the invention embodied therein comprises an arrangement or device for pre-heating liquid fuel which is supplied to a combustion device such as an internal combustion engine generally designated A and which burns a liquid fuel supply from a tank B through a supply line or main C to fuel supply means including a pump D. In accordance with the invention, a portion of the fuel which is supplied to the device A is burned at the combustion chamber of a and another portion is delivered back through a conduit or main E to the supply tank B so that the fuel which becomes heated in the device A heats the fuel in the tank B. In accordance with a feature of the invention, the conduit or main C which supplies the liquid fuel to the pump D includes a portion or wrapping generally designated 1 which comprises a plurality of coils of the conduit arranged in conductive heat exchange with the exhaust pipe 4 of the device A.

In the FIGS. 1 through 5 the respectively same positions bear the same position number.

FIG. 1 shows a liquid fueled hinter or heating installation with the inventive device. The heating installation A is fed with liquid fuel out of tank B. The fuel main or line C leads fuel to the pre-heating installation and includes a wrapping or coils 1. The main C includes a fuel inlet main 3 and a fuel outlet main 3. The fuel of a fuel pump (not shown) belongs to a heating device A and is supplied from the heater pump through main D.

The fuel flow canal or a fuel main E serves for the return of the non-burnt fuel into the fuel tank B. The exhaust gas of the heating device A is lead out through the exhaust gas main or pipe 4. In the case of the fuel pre-heating installation according to FIG. 2, the fuel main 1 includes a fuel conduit coil or wrapping in one layer and it includes the main 2 and the fuel outlet main 3 and is disposed on a jacket 10 over part of the exhaust pipe 4 and connected to it.

For the mounting support, there is a clamping connection with a clamp 5–6 provided. This clamp is composed of an inner u-shaped part 5, embracing the wrapping of the fuel main 1, and a screw 7 being disposed in it. The clamp is u-shaped, and it embraces an inner u-shaped part 5, a screw 7 extending through it, so that the outer part 6 can be moved by means of the screw nut 8 in order to establish the clamping connection of the pre-heating installation with the exhaust pipe 4. Between the screw nut 7 and the outer part 6 is a pressure plate 9. FIG. 3 shows a top view of the arrangement pursuant to FIG. 2 with the inner U-shaped part 5.

Figure 2:
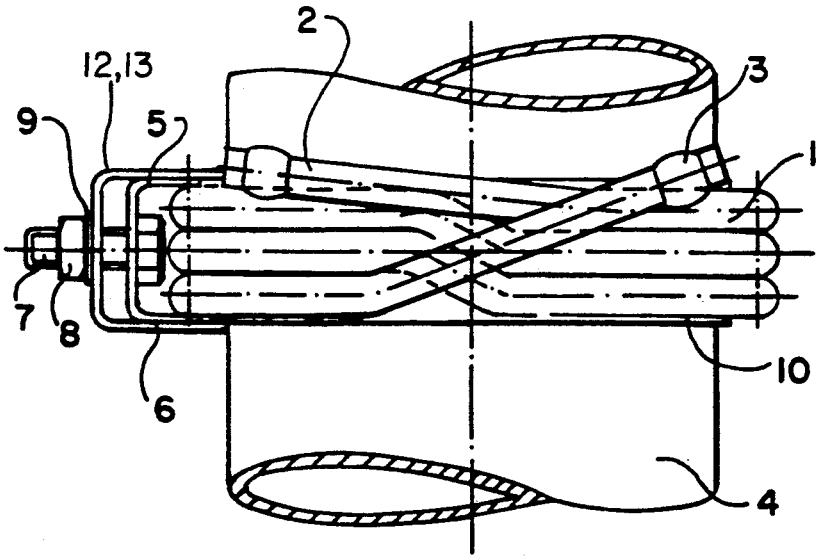
FIG. 2 is a side elevational view of the installation with a wrapped fuel main constructed in accordance with the invention.
Figure 3:
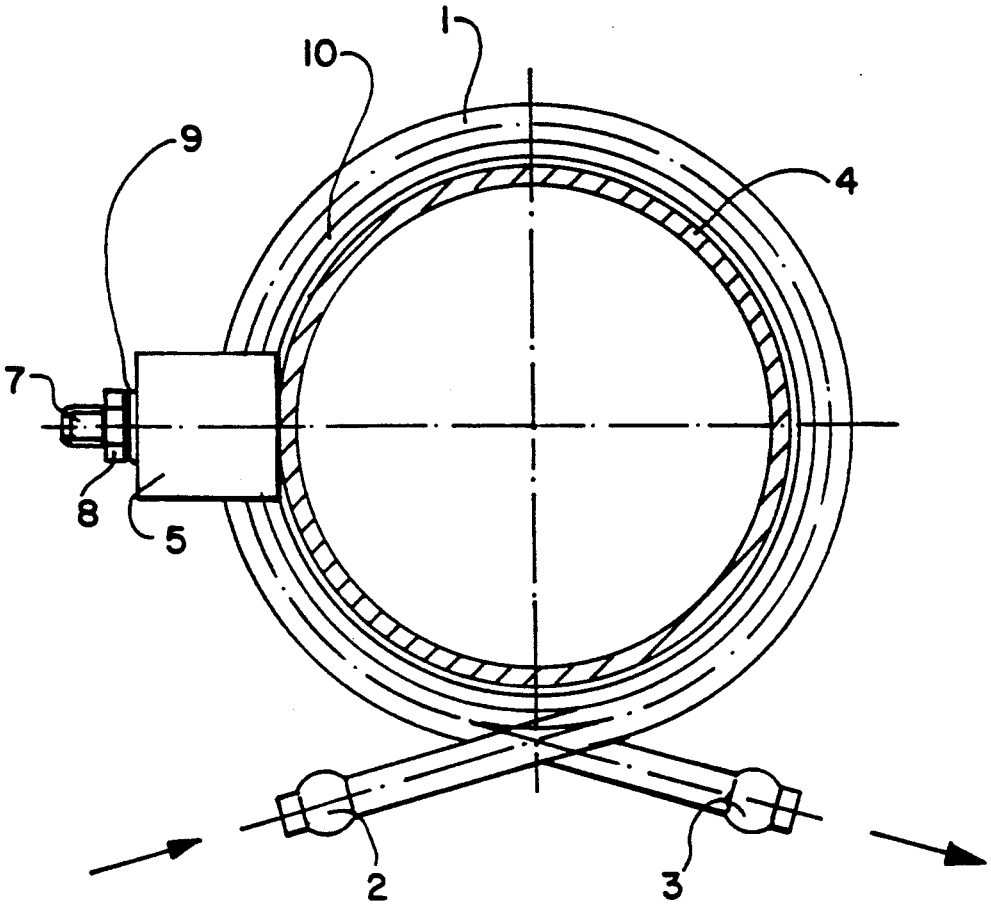
FIG. 3 is a top plan view pursuant to FIG. 1 with jacket.

In FIG. 4 another embodiment of a fuel pre-heating installation has, instead of the wrapping in one layer according to FIG. 2 and 3, the fuel blow canal is provided as a hollow cylinder with walls 12, 13 as a fuel carrier, the inner wall 12 lying on the exhaust gas pipe 4 or on an interposed jacket 10.

The outer wall 13 limits the fuel space 15, the fuel is supplied through the inlet main 2 and is lead away through the outlet main 3 to the fuel pump of the heating device A (FIG. 1). The attachment to the exhaust gas main 4 of the heating device is carried out by use of a pressure screw 7. FIG. 5 shows a variation according to FIG. 2, 3. Here the jacket 10 in FIG. 2, 3 is formed by a wrapping 17 in one layer of heat-transmitting material, the wrapping being connected with the fuel carrying wrapping 1 by means of a hard soldering 18.

The heat transmitting wrapping 17 is lead in such a way that it is situated below the contact lines of the wrapping 1. Since the stock round of the wrapping 17 is composed of a massive material and provides a smaller diameter than the mains of the wrapping 1, it is obtained as a result, that the wrapping 17 extend the width of the individual windings.

Figure 6:
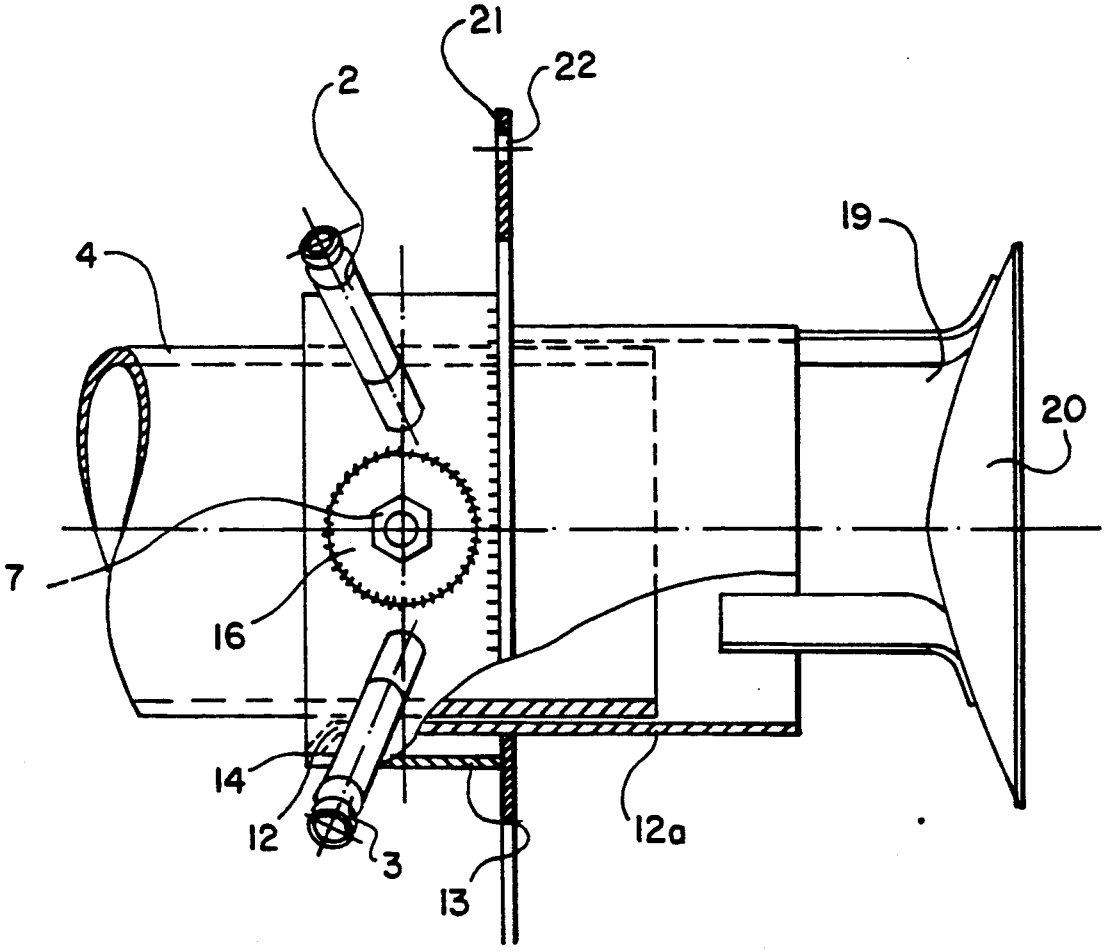
FIG. 6 is a view similar to FIG. 3 with baffle plate.

FIG. 6 shows a variation of the installation pursuant to FIG. 4. This variation is preferably for cowling onto the final section of the exhaust gas pipe 4, that is, the final tube or end tube.

In the case of this embodiment the inner wall 12 of the hollow cylinder 12, 13 is prolonged on one side around the section 12*a*. A disk 20, which is curved towards the inside is disposed and is as a baffle plate over preferably 3 cross pieces 19, which are attached to the section of the inner tube 12*a* and which in the mounting also serves as stops for the exhaust pipe 4 at the same time.

This baffle plate causes a deviation of the hot waste gases which leave the exhaust gas pipe 4, so that they do not blow directly onto the roadway or on parts of the carriage of the vehicle, but prevent the material from being burnt or its color from being altered. A flange 21 can be disposed on the hollow cylinder 12, 13, by means of which an attachment to the parts of the carriage, for example the bottom of a vehicle is possible through borings 22.

While specific embodiments of the invention have been shown and described in detail to illustrate the application of the principles of the invention, it will be understood that the invention may be embodied otherwise without departing from such principles.

What is claimed is:

1. A mobile unit heater liquid fuel preheating arrangement, comprising: a fuel tank; a heater element; a flue gas pipe having a heater end connected to the heater element and having a discharge end spaced a distance from the heater element for carrying flue gases generated in the heater away from the heater to the discharge end for discharging flue gases to atmosphere; a fuel flow canal; and flue gas pipe having a heat exchange section connected between the heater and the discharge end, said flow canal surrounding the heat exchange section of said flow gas pipe; a first fuel line connected to said fuel tank and connected to fuel flow canal; a second fuel line connected to said fuel flow canal and connected to said heater; a fuel pump connected to the heater in communication with said second fuel line and, a return fuel line connected to said heater and connected to said fuel tank for returning preheated fuel, not needed for combustion, to the fuel tank.

2. A device according to claim 1, wherein the fuel flow canal positioned at the heat exchange section includes a hollow cylinder which surrounds the flue gas pipe including a feed pipe connection connected to said first fuel line and a discharge connection connected to said second fuel line.

3. Heater in accordance with claim 1, wherein said flue gas pipe heat exchange section includes a sleeve arranged on said flue gas pipe and a fuel line formed as a coil, said sleeve being formed by a round single-layer wrapping of a heat-conducting material.

4. Heater in accordance with claim 3, wherein the round material forming the sleeve has a smaller diameter than said fuel line coil.

5. Heater in accordance with claim 2, wherein the hollow cylinder includes an inner wall extended on one side and a baffle plate consisting of an inwardly arched, flat plate which is connected to the inner wall via webs arranged at its end.

6. Heater in accordance with claim 2, wherein a flange is molded on the hollow cylinder.

7. Heater in accordance with claim 2 wherein the hollow cylinder is arranged on a sleeve.

8. A mobile unit heater liquid fuel preheating arrangement, comprising: a fuel tank; a heater element; an exhaust gas pipe having a heater end connected to the heater element and having a discharge end spaced a distance from the heater element for carrying exhaust gases generated in the heater away from the heater to the discharge and for discharging exhaust gases to atmosphere; a fuel flow canal, said exhaust gas pipe having a heat exchange section connected between the heater and the discharge end, said flow canal having at least one turn around the exhaust gas pipe, surrounding the heat exchange section of said flow exhaust pipe; a first fuel line connected to said fuel tank and connected to said fuel flow canal; a second fuel line connected to said fuel flow canal and connected to said heater; a fuel pump connected to the heater in communication with said second fuel line and, a return fuel line connected to said heater and connected to said fuel tank for returning preheated fuel, not needed for combustion, to the fuel tank said exhaust gas pipe heat exchange section including a sleeve arranged on the exhaust gas pipe, said fuel flow canal including a plurality of adjacent windings positioned on said sleeve, the sleeve of the heat exchange section and the windings of the fuel canal being maintained in engagement with the exhaust gas pipe by a clamping element.

9. Engine-independent heater operated with diesel fuel for vehicles, comprising:

a fuel tank, a fuel line connected between said fuel tank and a fuel pump associated with the heater, a fuel return line connected between the heater and said fuel tank, and an exhaust gas line removing exhaust gas from a combustion chamber of the heater, said fuel line, connecting the fuel tank to the fuel pump, having a section surrounding the exhaust gas line for preheating the diesel fuel, said surrounding section being formed by a one-layer wrapping of the fuel line arranged on a sleeve, by which the heat-transferring contact with the exhaust gas line takes place.

10. Heater in accordance with claim 9, wherein the wrapped section of the fuel line and the sleeve are held on the exhaust gas line by at least one surrounding clamp.

11. Heater in accordance with claim 10, wherein said clamp consists of an inner, U-shaped part, which is rigidly connected to the wrapped section of the fuel line and an outer U-shaped part surrounding said inner U-shaped part and that the surrounding outer U-shaped part is displaceable above said inner U-shaped part by means of a screw.

* * * * *